United States Patent [19]

Hirsch et al.

[11] Patent Number: 4,508,528

[45] Date of Patent: Apr. 2, 1985

[54] PAD-CROSS FOLDER

[75] Inventors: John L. Hirsch; Gene A. VanVoorst, both of Sheboygan Falls, Wis.

[73] Assignee: Curt G. Joa, Inc., Sheboygan Falls, Wis.

[21] Appl. No.: 454,406

[22] Filed: Dec. 29, 1982

[51] Int. Cl.[3] ..... B31F 1/08; B31F 1/10

[52] U.S. Cl. ..... 493/426; 493/435; 493/444; 493/937; 270/45

[58] Field of Search ..... 493/254, 426, 427, 434, 493/435, 443, 444, 445, 937; 270/45, 47

[56] References Cited

U.S. PATENT DOCUMENTS 1,906,638 5/1933 Schwartz ..... 270/47
4,022,456 5/1977 Hooper et al. ..... 493/444

FOREIGN PATENT DOCUMENTS 200072 6/1924 United Kingdom ..... 493/426

*Primary Examiner*—Lowell A. Larson

*Attorney, Agent, or Firm*—Fuller, House & Hohenfeldt

[57] ABSTRACT

In a cross-folder for flexible pads such as diapers a wide first conveyor belt runs over a segment of the periphery of a rotationally driven drum. A narrow second conveyor belt runs in parallelism with the first belt for transporting unfolded pads toward the drum and a third conveyor belt runs in parallelism with the first belt for transporting folded pads away from the drum. The drum carries diametrically opposite pairs of slidable members that are reciprocated radially inwardly and outwardly as the drum rotates under the influence of cam rollers on the members which run in stationary cam grooves. Pivotable levers are carried on the slidable members, respectively. The levers have fingers for gripping the pads at their mid-line. The levers have cam follower rollers which are forced to follow cam grooves carried by the drum and, under the influence of the slidable members, the levers are actuated to grip and release the pads to effect folding.

4 Claims, 8 Drawing Figures

PAD-CROSS FOLDER

BACKGROUND OF THE INVENTION

This invention relates to apparatus for cross-folding articles such as disposable diapers and other pads which may be worn on the body.

U.S. Pat. Nos. 3,552,736; 3,572,689 and 3,907,272 illustrate prior art folding apparatus.

SUMMARY OF THE INVENTION

The new pad folding apparatus is distinguished by its ability to cross-fold a soft article such as a diaper along a straight line such that if the articles are symmetrical from end to end their upper and lower halves will be absolutely congruent. The new folding apparatus is also distinguished by its ability to fold soft articles such as diapers at a high rate and by smooth operation and low maintenance requirements.

In accordance with the invention, a first conveyor belt runs over a segment of the circular periphery of a rotationally driven drum. A second conveyor belt runs in parallelism with that portion of the first conveyor belt that leads to a line or tangency between the first conveyor belt and the drum. The second conveyor belt and portion of the first conveyor belt cooperate with each other to transport an article such as a diaper toward the drum. A third conveyor belt is arranged in parallelism with the portion of the first conveyor belt that leaves the drum from a line of tangency. This portion of the first conveyor belt and the third conveyor belt are spaced from each other and cooperate to transport articles after they have been folded away from the drum. Levers that carry fingers are pivotally mounted on the drum. As the drum rotates, there are cam means that pivot and move the levers axially in an appropriate time relationship for the fingers, at one angle of drum rotation, to swing over the mid-line of the article and press it against the first conveyor belt. As rotation of the drum proceeds over a small angle the cam means actuates the levers in a fashion that causes the fingers to swing generally radially outwardly from the article and retract axially from the article at a time when the leading end of the folded article is already positively gripped between the first and third conveyor belts. The article is always positively held between either the first and second conveyor belts before being gripped by the fingers and then by the fingers themselves and then by the cooperating third and first conveyor belts.

Other objects, features and advantages of the new cross-folder will appear in the ensuing description of a preferred embodiment of the invention which will now be set forth in reference to the drawings.

DESCRIPTION OF A PREFERRED EMBODIMENT

Figure 1:
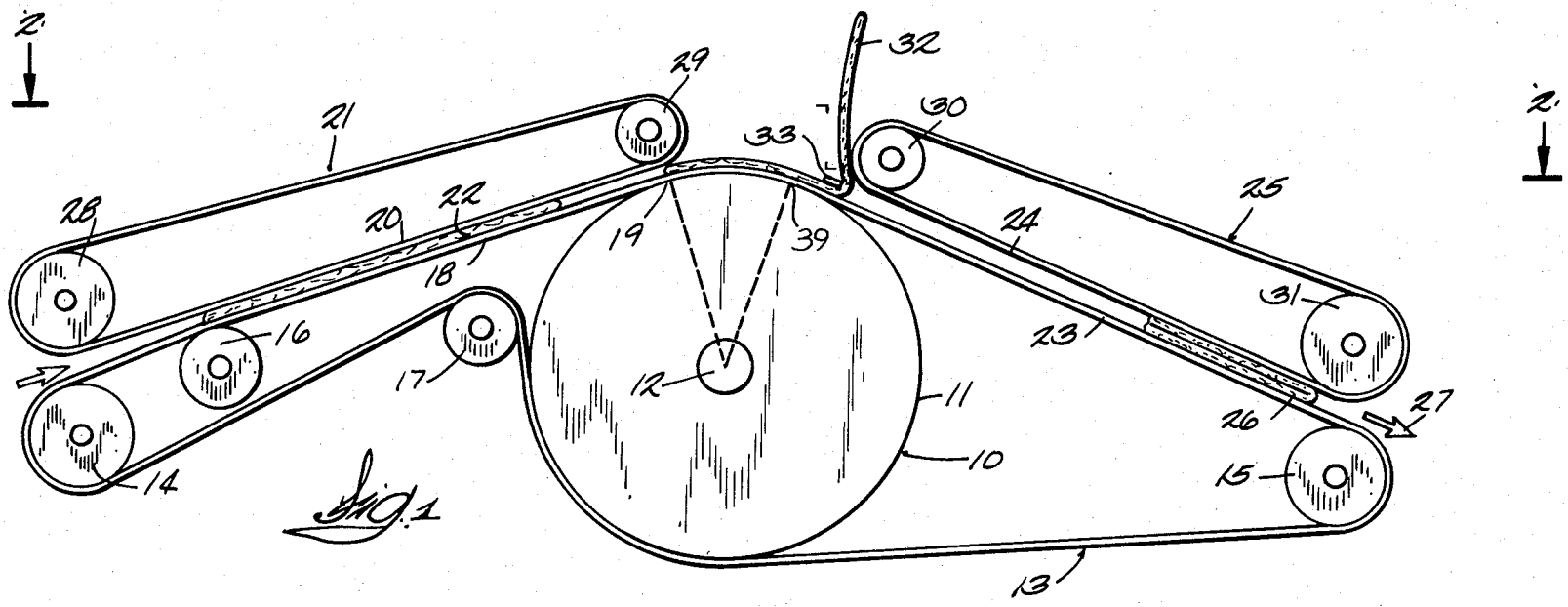
FIG. 1 is a diagrammatic side elevation view for illustrating the general arrangement of the cross-folder drum and its associated conveyor belts.

In FIG. 1, the drum-folder arrangement is designated generally by the reference numeral 10. The diagrammatically shown drum is marked 11. It rotates on a power-driven shaft 12. A first closed-loop conveyor belt 13 runs over a segment of the periphery of drum 11. Conveyor belt 13 runs on pulleys 14 and 15, a belt back-up pulley 16, and a pulley 17 that is shiftable to tighten the belt onto the periphery of drum 11. In the illustrative embodiment, the power driven drum frictionally engages belt 13 and translates it. The converse would also be possible, that is, a pulley such as the one marked 14 could be driven rotationally to translate the belt and let it cause rotation of the drum 11.

In FIG. 1, one portion 18 of the first conveyor belt 13 runs to a line of tangency on the drum which is about where the reference numeral 19 is applied. Portion 18 of belt 13 runs in parallel to a straight portion 20 of a second closed-loop conveyor belt 21. The lower portion or run 20 of the second conveyor belt is substantially parallel with and spaced from portion 18 of the first conveyor belt so the belts can cooperate to transport one of the unfolded articles 22 such as a flat disposable diaper or other soft pad, toward the line of tangency 19 on rotatable drum 11. A portion 23 of first conveyor belt 13 runs away from a line of tangency on drum 11 where the reference numeral 24 is applied. Belt portion 23 is spaced from and in substantial parallelism with the lower run 24 of a third closed-loop conveyor belt 25. The lower run 24 of the third conveyor belt cooperates with the run 23 of the first conveyor belt to transport articles that have been folded, such as the one marked 26, away from the drum 11 for discharge in the direction of the arrow 27. In a pad manufacturing machine, not shown, the folded pads 26 might be discharged to a stacker, not shown.

The second conveyor belt 21 runs on pulleys 28 and 29. The third conveyor belt 25 runs on pulleys 30 and 31. All of the pulleys are driven synchronously from the pad making machine, not shown, such that the liner velocities of the conveyor belts 21, 25 and 13 and the linear velocity of the drum 11 periphery are equal.

FIG. 1 also shows a soft article 32, such as a diaper, in a partially folded state. Note that one finger 33 of a cooperating pair of fingers including one marked 34 that is not shown in FIG. 1, is pressing the pad 32 against the first conveyor belt 13 during the folding operation. As will be explained later, the fingers are controlled to release their grip or leave the pad 32 only after the pad has been gripped between the cooperating discharge belt runs 23 and 24. In other words, as will be explained in greater detail later, the fingers engage an incoming pad, such as the one marked 18, slightly before or at the line of tangency 19 on drum 11 and maintain their gripping force on the pad during the time that the pad is moving along the segment of the drum 11 periphery between the lines of tangency 19 and somewhat thereafter.

Figure 2:
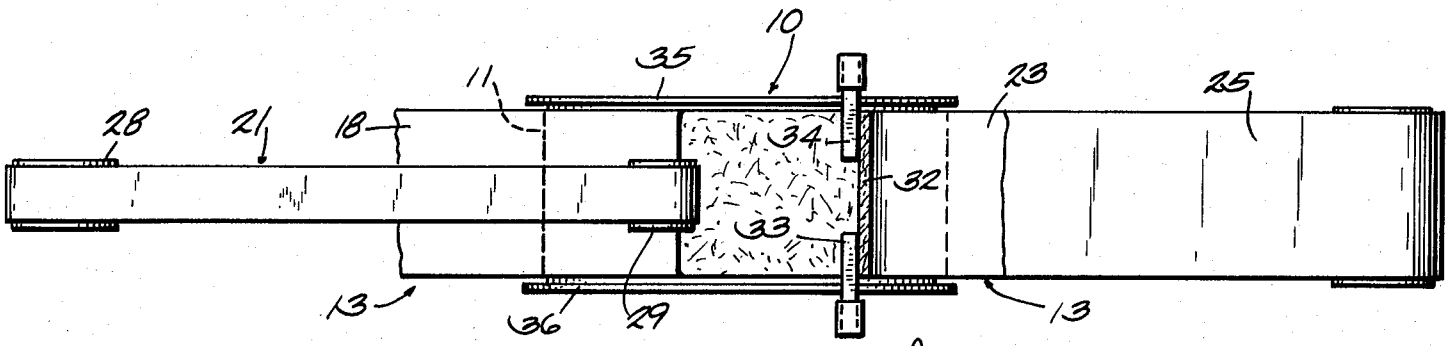
FIG. 2 is a diagrammatic plan view of the apparatus depicted in FIG. 1.

Note in FIG. 2 that the second conveyor belt 21 is narrower than the first conveyor belt 13 such that the tips of the orbiting gripper fingers 33 and 34 will never overlap conveyor belt 21. Note also in FIG. 2 that drum 11 is provided with a pair of end flanges 35 and 36 which also appear in FIGS. 3 and 4 in connection with which a more detailed description of the cross-folder assembly as actually constructed will now be set forth.

Figure 4:
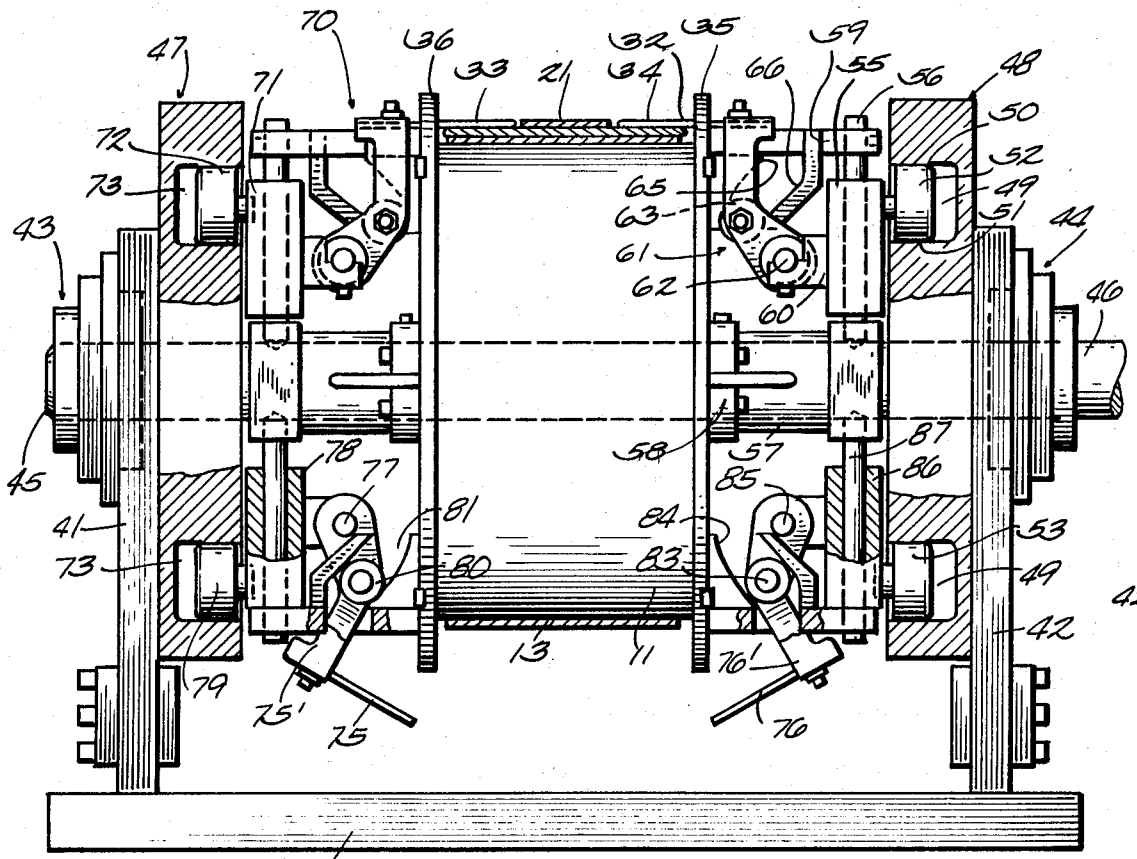
FIG. 4 is a vertical section taken on a line corresponding with 4—4 in FIG. 3.

In FIG. 4, the cross-folder mechanism comprises a frame including a base 40 to which upstanding side plates 41 and 42 are fastened. Bearing housings 43 and 44 are fastened to side plates 41 and 42, respectively. A shaft 45 is journaled for rotation in bearing housings 43 and 44. One end 46 of shaft 45 is shown broken away. In the actual machine, end 46 of shaft 45 has a sprocket, not shown, on it for being driven by a chain, not shown, synchronously from the drive shaft of a diaper-making or other pad-making machine, not shown, with which the cross-folder is affiliated.

As shown in FIG. 4, the cross-folder includes two stationary cam plates 47 and 48 which are fastened to upright side members 41 and 42, respectively. Cam plates 47 and 48 are identical. Considering typical cam plate 48, it has an internal cam groove 49 having an outside surface 50 and an inside surface 51. The profile of the cam groove as defined by surfaces 50 and 51 can be seen in FIG. 3. Two cam follower rollers 52 and 53 run in cam groove 49. Typical cam follower roller 52 has a shaft 54 on which the roller is journaled for rotation. Shaft 54 is fastened to a radially slidable or reciprocating member 55. Member 55 is slidable on a rod 56 whose radial inward end is fastened in a hub 57 which is, in turn, fastened by means of an adapter 58 to the flange 35 of the drum 11 and to shaft 45. The radial outward end of rod 56 is fastened in a bracket 59 which is also fastened to the drum flange 35. A boss 60 extends fixedly from radially slidable member 55. A lever 61 is mounted to this boss for pivoting about the axis of a shaft 62. Lever 61 has a stub shaft 63 fastened to it by means of a nut as shown. There is a cam follower roller 64 journaled for rotation on stub shaft 63. Cam follower roller 64 is movable in a path defined by angulated camming surfaces 65 and 66 which are formed by members extending radially inwardly from bracket 59. As the drum 11 rotates, typical slidable member 55 moves on rod 56 alternately radially outwardly and inwardly in correspondence with the angular or rotational position of cam roller 52 in stationary cam groove 49. As slidable member 55 reciprocates radially outwardly and inwardly it carries lever 61 with it in which case the follower roller 64 on the lever is caused to follow the angulated camming surfaces 65 and 66. Because of the angulation of camming surfaces 65 and 66, lever 61 is caused to pivot in a clockwise direction on pin 62 as slidable member 55 moves radially outwardly.

A finger 34 having the characteristics of a flat spring is fastened to the outer end of typical lever 61. Thus, when the parts are in the relationship shown in FIG. 4, finger 34 and finger 33 as well are pressing the elongated soft article 21 at its midline and folding takes place along the edges of circumferentially aligned fingers 33 and 34. Referring back to FIG. 1, one may see that the soft article 32 now has its leading end standing upright. As rotation of drum 11 in FIG. 1 continues, the folded edge is moved to between conveyor belts 23 and 24 so they positively engage the folded article and keep the upper and lower layers congruent. Upon further rotation of drum 11, the fingers are pivoted away from the article and moved axially by the cooperative action of cam roller 64 on lever 61 in FIG. 4 and the cam surfaces 65 and 66.

Referring to FIG. 4, axially aligned with the finger operating mechanism just described is a similar mechanism which is indicated generally by the reference numeral 70. It includes a slide member 71 that is similar to its mate 55. This slide member 71 is reciprocated by a cam follower roller 72 which orbits in cam groove 73 of cam plate 47. Cam roller 72 is in rotational phase with its counterpart cam roller 52 so that fingers 33 and 34 pivot radially and shift inwardly and outwardly in synchronism. Note in FIG. 3 that the drum flanges such as the one marked 35 have notches 74 in their periphery to allow the fingers, such as the one marked 34, to come down on the article 32 that is being folded.

Figure 3:
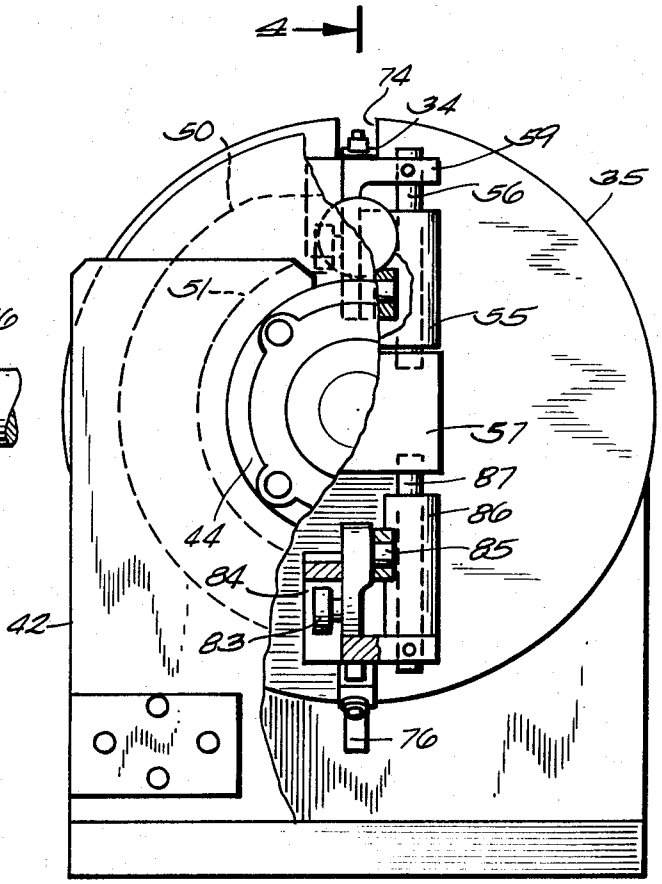
FIG. 3 is a detailed side elevation view of the drum-folder assembly with parts broken away.

As shown in FIGS. 3 and 4, there is another pair of folding fingers 75 and 76 which are diametrically opposite or circumferentially spaced 180° from fingers 33 and 34. Typical finger 75 is mounted on a lever 75' which is similar to lever 61. Lever 75' pivots on a pin 77 which is mounted to a slide member 78 which is similar to slide member 55. The cam roller for reciprocating slide member 78 radially is marked 79. The lever has a cam follower roller 80 which moves in the path of the cam groove 81 to cause the lever and finger 75 to swing radially outwardly and retract axially outwardly to release the article being folded at an appropriate time in the rotational position of the drum 11.

Finger 76 is, of course, operated in synchronism with finger 75. The mechanism for operating finger 76 comprises lever 76', a cam follower roller 83, cam surfaces 84, a lever pivot 85 mounted to slide member 86, a rod 87 for guiding the slide member and a cam roller 53 which runs in stationary cam groove 49.

Figure 5:
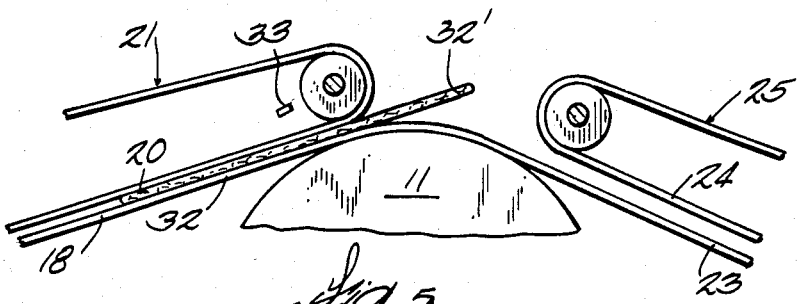
FIGS. 5–8 are diagrams for describing the sequence of operations involved in folding a typical soft article such as a diaper.

The operating sequence of the cross-folder will now be described in reference to FIGS. 5–8. In these figures only one finger 33 in an axially aligned pair of fingers which includes finger 34 is shown. In FIG. 5, finger 33 is in an attitude comparable to fingers 75 and 76 in FIG. 4 at the moment. An article such as a diaper 32 has been transported between first conveyor belt portion 18 and second conveyor belt portion 20 to the position in which it is shown in FIG. 5. Note that the diaper approaches the periphery of the drum 11 tangentially so its leading end 32' is away from the drum. The leading end follows the tangential path of the drum. The fold begins after the finger 33 pulls the center of the diaper around the drum. In FIG. 5 finger 33 is still retracted axially outwardly from the edge of narrow belt 21 and it is pivoted radially outwardly from the drum due to the camming action on the lever that supports the finger.

Figure 6:
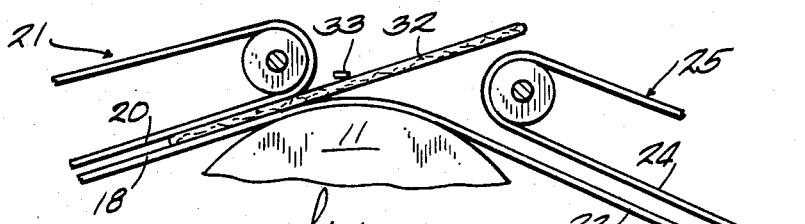

In FIG. 6, drum 11 has rotated clockwise from its FIG. 5 position and the finger 33 and, of course, its counterpart 34 are in contact with the mid-line of the diaper and are pressing the diaper against the drum and the conveyor belt running on it.

Figure 7:
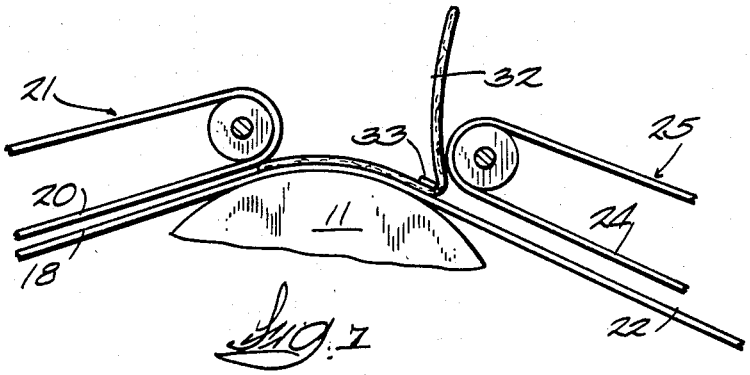

In FIG. 7, drum 11 has rotated clockwise by an additional angle relative to its FIG. 6 position. Typical finger 33 is still pressing against the diaper 32 mid-line and the fold is just beginning to enter between the third conveyor belt portion 24 and the first conveyor belt portion 22.

Figure 8:
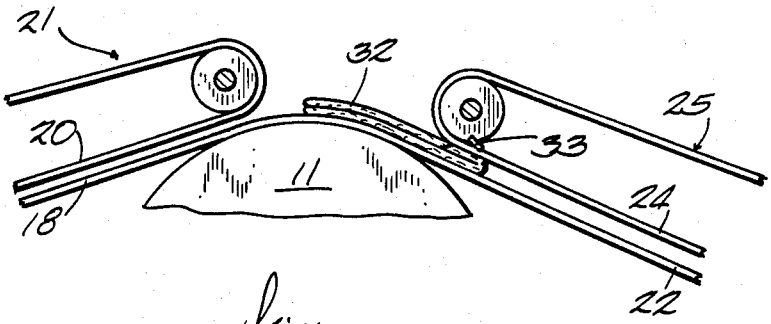

It is only after the diaper 32 has entered between conveyor belt sections 24 and 22 as in FIG. 8 that the finger 33 begins to pivot radially outwardly from drum 11 and to retract axially relative to the drum and the narrow belt section 24 in which case the diaper becomes positively gripped by the cooperating belt portions 22 and 24 so that the overlaying parts of the diaper remain congruent as it is conveyed further for discharge from between the conveyor belts.

It should be evident that if fingers 33 and 34 are involved in folding one diaper in a series, the other pair of fingers 75 and 76 will be involved in folding the next diaper in the series and so on because, in the illustrated embodiment, the diapers are conveyed into the folder with a lineal distance between them equal to one-half of the circumference of the drum.

Although an embodiment of the invention has been described in detail, such description is intended to be illustrative rather than limiting, for the invention may be variously embodied and is to be limited only by interpretation of the claims which follow.

We claim:

1. Apparatus for cross-folding pads such as diapers, comprising:

a drum for being driven rotationally, a first conveyor belt having a portion running toward the drum to a first line of tangency therewith and a portion running away from the drum from a second line of tangency therewith, and a portion between said lines of tangency in contact with a segment of the periphery of the drum, a second conveyor belt running in parallelism with the portion of the first belt running toward the first line of tangency with the drum for engaging an unfolded pad between them and transporting it tangentially to the drum, a third conveyor belt in parallelism with the portion of the first belt running away from the second line of tangency for engaging a folded pad between them and engaging and transporting it away from the drum, guide means at each end of the drum and mounted for rotation with the drum and a slide member mounted for sliding on the respective guide means radially of the drum, means for reciprocating said slide members alternately radially inwardly and outwardly in response to drum rotation, a lever mounted for pivoting on each said slide member and a finger extending from each lever toward the drum, means for guiding said levers and the fingers to pivot axially away from said drum and to move radially outwardly when the slide members are moving radially outwardly of the drum to thereby permit an unfolded pad to pass clear of the fingers for the leading end of the pad to extend tangentially from the drum and for guiding said levers to pivot axially toward the drum and to move radially inwardly when said slide members are moving radially inwardly to thereby cause said fingers to press said pad in opposite directions along its fold line at a time when the trailing end of the pad is still held between the first and second conveyor belts whereupon continued rotation of said drum will cause said pad to fold over, said slide members then moving radially outwardly again to release the fingers from the folded pad after the pad has been engaged for transportation between said third conveyor belt and the portion of the first belt that runs away from said second line of tangency.

2. The cross-folder according to claim 1 wherein said means for reciprocating said slide members radially inwardly and outwardly in correspondence with drum rotation comprise stationary members having a cam groove and displaced axially from the drum and a follower disposed in the cam groove and attached to the slide member, said cam groove being generally eccentric to the axis of drum rotation.

3. The cross-folder according to claim 1 wherein said second conveyor belt runs centrally to and is narrower than the first conveyor belt so that the fingers do not overlap the second conveyor belt when they press the pad on the first belt.

4. The cross-folder according to any of claims 1, 2 or 3 wherein said means for guiding said levers comprise elements defining a passageway that is disposed angularly radially and axially relative to the drum and said levers are provided with followers disposed in the passageway such that when the slide members move radially said levers move radially and axially as do the fingers.

* * * * *